US005888343A

United States Patent [19]

Olson

[11] Patent Number: 5,888,343

[45] Date of Patent: Mar. 30, 1999

[54] LABELING APPARATUS AND METHOD

[75] Inventor: Donald W. Olson, Mora, Minn.

[73] Assignee: Fingerhut Corporation, Minnetonka, Minn.

[21] Appl. No.: 523,220

[22] Filed: Sep. 5, 1995

[51] Int. Cl.[6] ..... B65C 9/00

[52] U.S. Cl. ..... 156/556; 156/542; 156/361; 156/363

[58] Field of Search ..... 156/542, 540, 156/541, 568, DIG. 31, 361, 364, 363, DIG. 38

[56] References Cited

U.S. PATENT DOCUMENTS 4,294,644 10/1981 Anderson ..... 156/361
4,324,608 4/1982 Klinger ..... 156/542 X
4,556,443 12/1985 Moya ..... 156/DIG. 38 X
4,687,535 8/1987 Voltmer ..... 156/363 X
5,102,485 4/1992 Keeler et al. ..... 156/568 X
5,281,296 1/1994 Beliveau ..... 156/542
5,549,783 8/1996 Schroeder et al. ..... 156/542

*Primary Examiner*—James Engel
*Attorney, Agent, or Firm*—Merchant, Gould, Smith, Edell, Welter & Schmidt, P.A.

[57] ABSTRACT

An apparatus for applying labels from a label web to moving articles such as a form web includes a moving belt, through which is applied a vacuum force, which successively receives a non-adhesive side of each label as they are removed from the backing web. A control system accelerates the belt in order to place the label onto a moving article located beneath the belt. The control system the decelerates the belt in order to receive another label and repeat the process of applying the label.

20 Claims, 8 Drawing Sheets

LABELING APPARATUS AND METHOD

FIELD OF THE INVENTION

The present invention relates to an apparatus and method for applying labels to moving articles, and more particularly to an apparatus and method for applying labels from a label web to a moving form web.

BACKGROUND OF THE INVENTION

Machines have been developed in order to apply labels to a moving form web. This is desirable where one wants to apply labels to a large number of articles such as catalogs or other printed forms. Typically, the label is shorter than the form. For example, the form may be eleven inches long and the label two inches long. Accelerating and decelerating the labels to match the form speed allows for continuous label placement on the moving forms. Applying the labels to the forms by hand labor would be time consuming and expensive.

An example of such a device is described in U.S. Pat. No. 4,294,644 to Anderson. This machine uses a motor to pull a label web around a curved edge. The label web includes a series of adhesive labels on a web backing. At the edge, the labels are separated from the backing and applied to a moving form web positioned beneath the curved edge. The device uses sensors to detect a position of a form to receive a label and uses that information to calculate when to apply the label to the moving form web.

The machine described in the '644 patent has limitations, however. For example, there is a limit to the speed at which the motor may pull the label web around the curved edge. Accelerating the label web to match the form web moving at higher speeds may cause the label web to break at the edge due to the increased tension resulting from the higher speed. Therefore, as the speed of the form web increases due to advances in printing technology, this machine will not be able to keep up with those increased speeds. In addition, this machine requires a high degree of accuracy in placing the labels at a particular position onto the moving form web. Since the form web is moving at a high rate of speed, the particular position which is to receive the label is only beneath the curved edge of the machine for a very brief instant. The machine must, therefore, be very accurate when applying the label to the moving form web in order to place the label in a precise position on the form web.

Accordingly, a need exists for an improved apparatus and method for applying labels to moving articles and in particular for increased speed and accuracy for applying the labels. Such an apparatus and method would allow for label application at increased form web speeds, such as from increased printer speeds.

SUMMARY OF THE INVENTION

This invention is an apparatus and method for applying labels to moving articles. The method includes the steps of receiving a plurality of adhesive labels located on the backing web and continuously removing the backing web from the labels. A moving belt, through which is applied a vacuum force, successively receives a non-adhesive side of each label without the backing web. The belt is then accelerated in order to place the label onto a moving article located proximate the belt.

The apparatus includes a vacuum belt mounted to a base for rotational movement, the belt having a plurality of holes through which is applied a vacuum force. A motor is coupled to cause rotational movement of the belt. A control system is coupled to the motor for controlling the rotational movement of the belt such that the belt receives a non-adhesive side of a label without the backing web, using the vacuum force, and accelerates the label for placement upon a moving article.

A further apparatus in accordance with the invention includes a backing web conveying device for separating labels from a backing web. A vacuum belt is mounted to a base to be rotated by a motor coupled to a drive roller. A vacuum chamber is located proximate the belt for applying a vacuum force through the belt, which is positioned adjacent to the backing web conveying device for receiving labels separated from the backing web.

A further method in accordance with the invention includes providing an adhesive label having an adhesive side and a non-adhesive side which is transferred from a backing web to a rotating belt. The non-adhesive side of the label is held against the belt with a vacuum force applied by a vacuum chamber positioned along a portion of the belt. The belt is rotated to move the label held to the belt away from the vacuum chamber. After the label is moved away from the vacuum chamber, the label is transferred from the belt to an article positioned adjacent to the belt, wherein the adhesive side of the label is applied to the article.

DETAILED DESCRIPTION

This invention provides a significant improvement in applying labels from a label web onto a moving form web or other articles. The apparatus includes a unique labeling head which includes a belt through which is applied a vacuum force. The belt initially moves at a speed approximately equal to the speed at which the labels are separated from a backing web. The belt receives a label and holds a non-adhesive side of the label against the belt using the vacuum force. The belt is then accelerated in order to match a speed of a moving form web and, while the speeds are matched, to apply the label at an appropriate place onto the moving form web. The use of the vacuum belt allows labels to be applied at a higher rate of speed and also allows additional time for accurate placement of the label onto the moving form web. With the use of the belt, label web speed limitations no longer have as large an impact on the label placement process.

Even though labels are shown as being applied to a form web, such as catalogs in a printing operation, the labels may be applied to any other type of articles. Examples of other articles to which labels may be applied include magazines; printed forms in general; and bottles or other containers.

Figure 1:
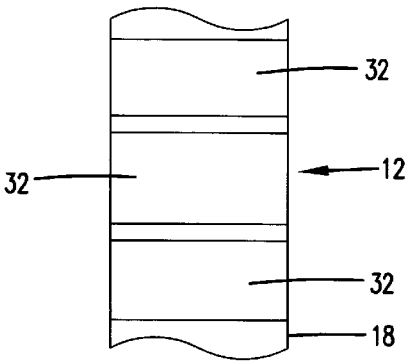
FIG. 1 is a diagram of a label web.

FIG. 1 is a diagram of a label web 12, which includes the labels to be applied to articles. The label web includes a web backing 18 on which is located a plurality of adhesive labels 32. The labels 32 are positioned with the adhesive side against the label web backing 18. The other side of the labels is a non-adhesive side and typically contains pre-printed information. These labels may be provided in a plurality of different sizes and with varying information printed thereon. In addition, the labels 32 may also contain additional labels positioned on their non-adhesive side.

Figure 2:
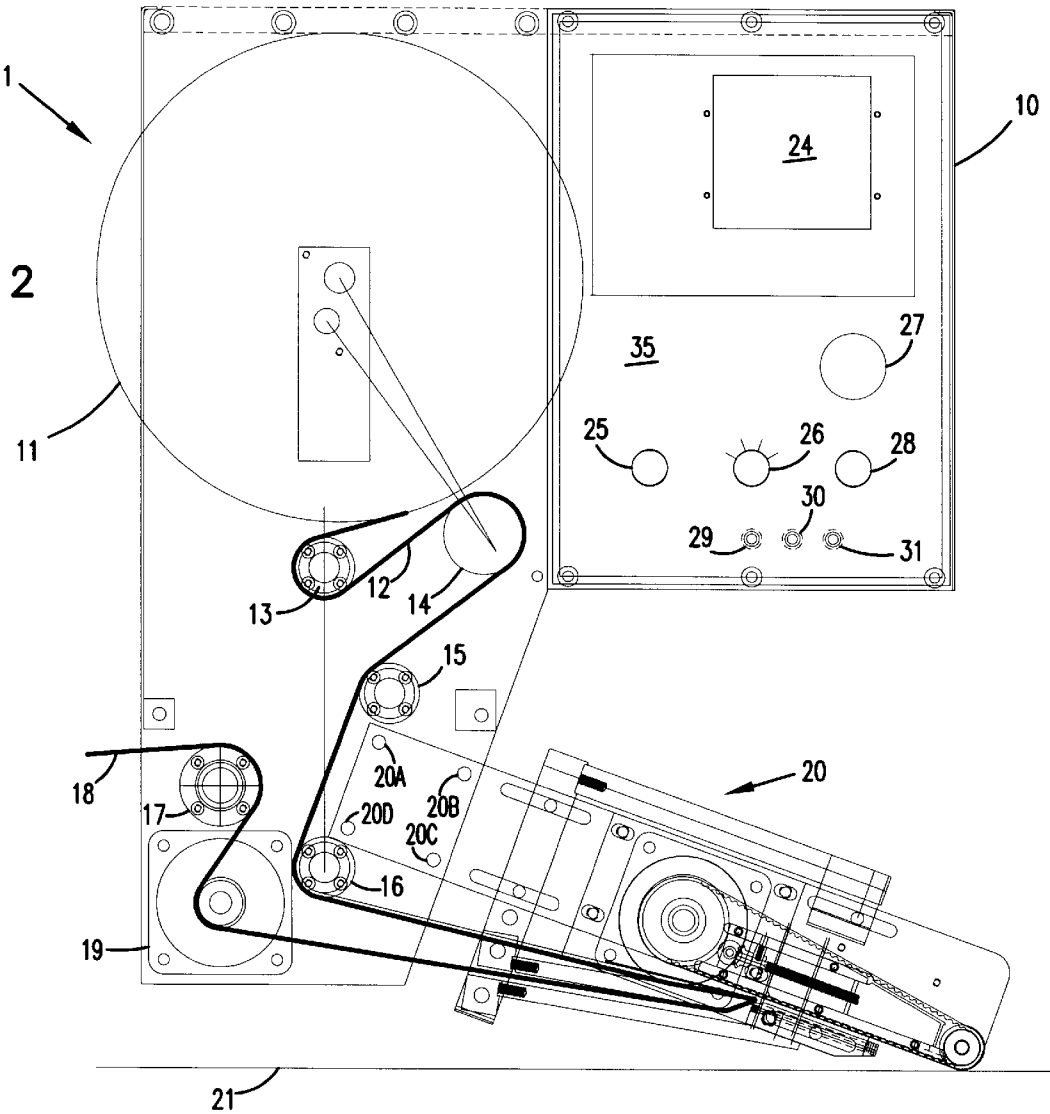
FIG. 2 is a side view of an apparatus for applying labels according to the principles of the present invention.

FIG. 2 is a diagram of an apparatus 1 for applying labels according to the principles of the present invention. The apparatus 1 includes a base or cabinet 10 which includes control circuitry for controlling the application of labels. A label roll 11 is mounted to the cabinet for supplying a label web 12 on which is located a plurality of labels. The label web 12 is fed around roller 13 and dancer 14 which applies tension to the label web in a known manner. The label web 12 is then fed around rollers 15 and 16 into a web conveying bracket (described below). A web motor 19 pulls the label web backing 18 around the web conveying bracket in order to separate the labels from the web backing 18. The web backing 18 is then fed around roller 17 and delivered to, for example, a take-up roller which applies tension to the label web backing.

A labeling head 20 contains the apparatus which receives the label from the web conveying bracket and applies the label to the moving form web 21. The labeling head 20 is described in detail below. The labeling head 20 is typically mounted to the cabinet with bolts 20A–20D.

The apparatus in the cabinet 10 also interfaces with a mark sensor 22 for detecting marks on the form web 21 via reflection. This detection is used for determining where to apply a label onto the moving form web. Other types of sensors, such as conventional transistor emitters and corresponding photodiodes, may be used in connection with applying labels to other types of articles.

The cabinet 10 also includes a control panel 35. The control panel 35 typically includes: a power indicator 25; a knob 26 for adjusting a form length setting; a manifold pressure gauge 27 for monitoring a source of vacuum pressure; a learn button 28 used to initialize parameters for controlling operation of the device; and an LED display and numeric keypad 24 for entry of the necessary servo delay for desired label placement in relationship to the printed web mark on the form web 21 read by sensor 22. Placement of the label relative to the width dimension (cross-direction) of the form web 21 is varied by initially moving the labeling head 20 to the desired position. LED displays 29, 30, 31 indicate the on/off status of three different sensors. The displays 29 and 30 are for label sensors described below, and the display 31 is for the form sensor 22. Control circuitry, described below, is coupled to control panel 35 for interfacing with the various indicators and controls.

Figure 3:
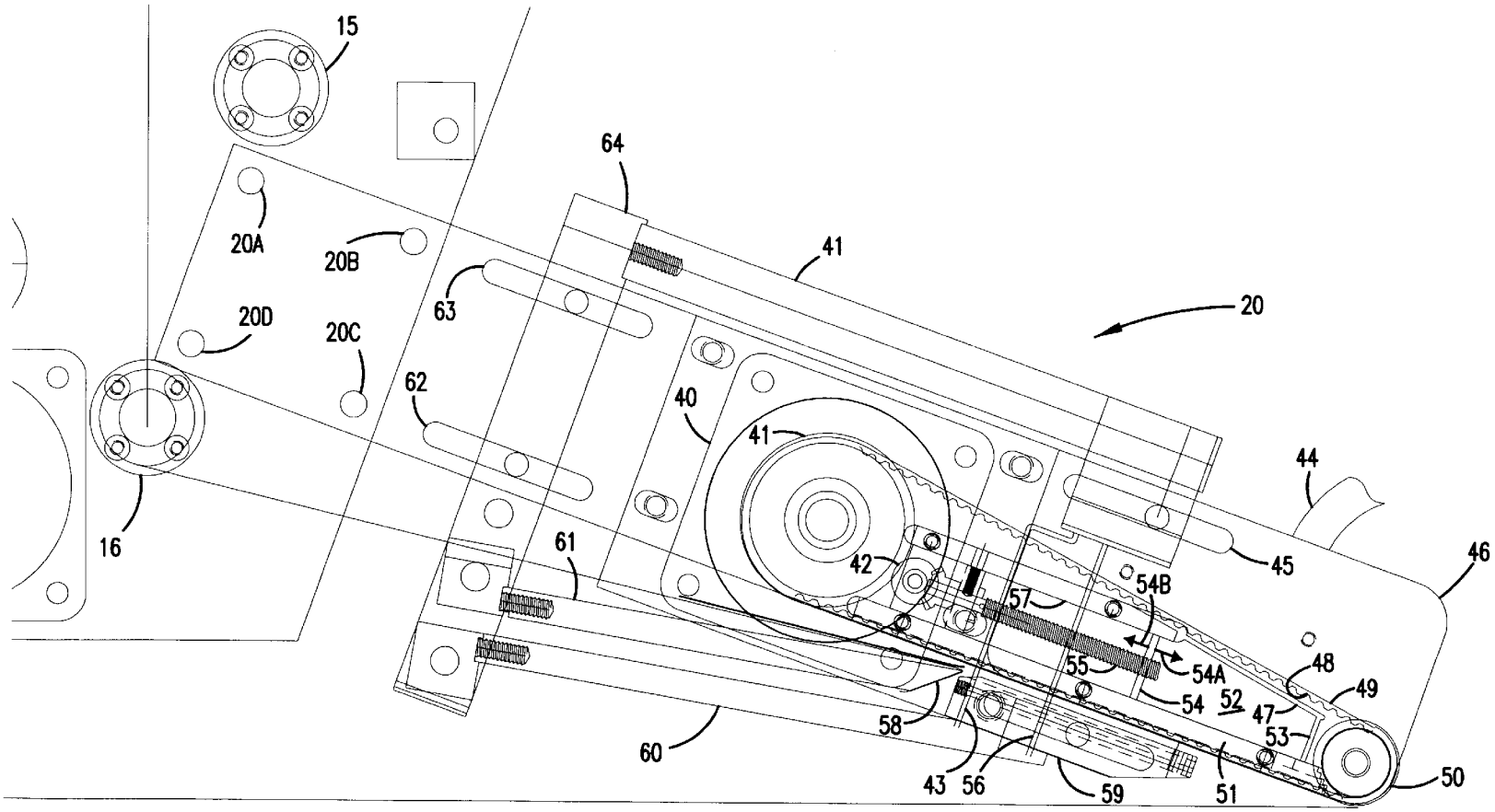
FIG. 3 is an enlarged side view of the labeling head of the apparatus shown in FIG. 2.

FIG. 3 is a more detailed diagram of the labeling head 20. The labeling head 20 includes two side plates 46 (see FIG. 5), one of which is shown in FIG. 3, mounted to the cabinet 10 using bolts 20A–20D. A motor 40 with a drive roller 41 is used for rotating a vacuum belt 49 around roller 50. The vacuum belt 49 is preferably implemented with a timing belt containing grooves 48 and comprises two vacuum belts mounted side by side with a space in between. The vacuum belt 49 includes a plurality of holes through which is applied a vacuum force.

Within the vacuum belt 49 is a vacuum chamber 52 for applying the vacuum force through the belt 49. The vacuum chamber 52 is defined by a front section 53, a top section 47, a baffle 54 and possibly baffle top portion 57 depending on the location of the baffle 54, and a vacuum plate 51. The baffle 54 allows a user to adjust an effective size of the vacuum chamber 52. The baffle 54 may be moved in directions 54A and 54B by a screw 55. A baffle adjustment mechanism 42 is mechanically coupled, using bevel gears, to the screw 55 in order to allow a user to adjust a position of the baffle 54. The baffle adjustment mechanism 42 may be a knob located on an outside of the side plate 46, the knob being mechanically coupled to the screw 55.

The vacuum plate 51, as further described below, defines a plurality of holes through which is applied the vacuum force. A vacuum hose 44 is in airflow communication with the vacuum chamber 52 and is also coupled to a source of vacuum pressure, which provides, for example, a pressure of 1.5–5 inches of mercury. A low pressure-high volume vacuum is desired. The grooves 48 in the vacuum belt 59 allow the vacuum force to spread out more evenly across the vacuum plate 51.

Also mounted to side plates 46 is a connecting member 64. The connecting member 64 is used to mount a top bracket 41. A bottom bracket 60 is also mounted to connecting member 64. Through-beam sensors 43 and 56 are mounted to connecting member 64 for sensing a label on the vacuum belt. The through-beam sensors 43 and 56 each with an emitter and a detector are conveniently mounted to the top and bottom brackets 41 and 60. Fiberoptic through-beam sensors SA1C-F1N3E with cables SANFTM22 from I-DEC Corporation of Sunnyville, Calif., are one example of suitable sensors to detect the label. Preferably, sensors 43 and 56 have a response time of less than 100 microseconds.

A web conveying bracket 61 is also mounted to connecting member 64. The web conveying bracket 61 includes a lip or edge surface 58, at which the labels are separated from the backing web by the backing web being pulled around the edge surface 58 by the motor 19. The labeling head 20 preferably also includes an airstream device 59 for projecting an airstream at the adhesive side on the label as it passes over the edge surface 58 in order to assist in transferring the label from the edge surface 58 to the vacuum belt 49. Airstream device 59 may create a puff or short pulse of air at the desired time to assist in the transfer of label to the vacuum belt 49. Alternately, a continuous airstream can be provided. Sensor 43 can detect the leading edge of the label and provide an input to the control system to control the air from airstream device 59. The airstream is provided, for example, with a pressure of 10–40 pounds per square inch (psi). The connecting member 64, and structure which is mounted to it, may be adjusted by slots 45, 62 and 63.

Figure 4:
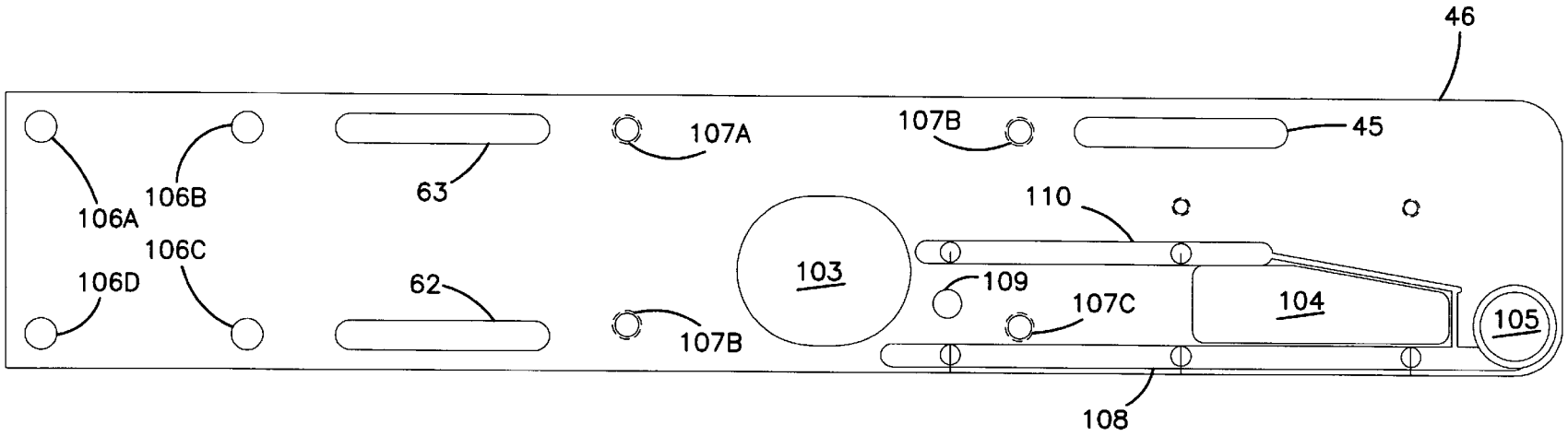
FIG. 4 is a side view of the side plate of the labeling head.

FIG. 4 is a diagram of the side plates 46, which preferably comprise two side plates identical to the one shown. As mentioned above, the side plates 46 include slots 45, 62, and 63 for adjusting positions of the sensors and web conveying bracket. The side plates 46 also preferably include apertures for: locating the motor 40 (103) and mounting the motor 40 (107A–107D), locating the vacuum chamber 52 (104), locating the roller 50 (105), attaching the bolts 20A–20D (106A–106D), locating the baffle adjustment mechanism 42 (109), mounting the vacuum plate 51 (108), and mounting the baffle top portion 57 (110).

Figure 5:
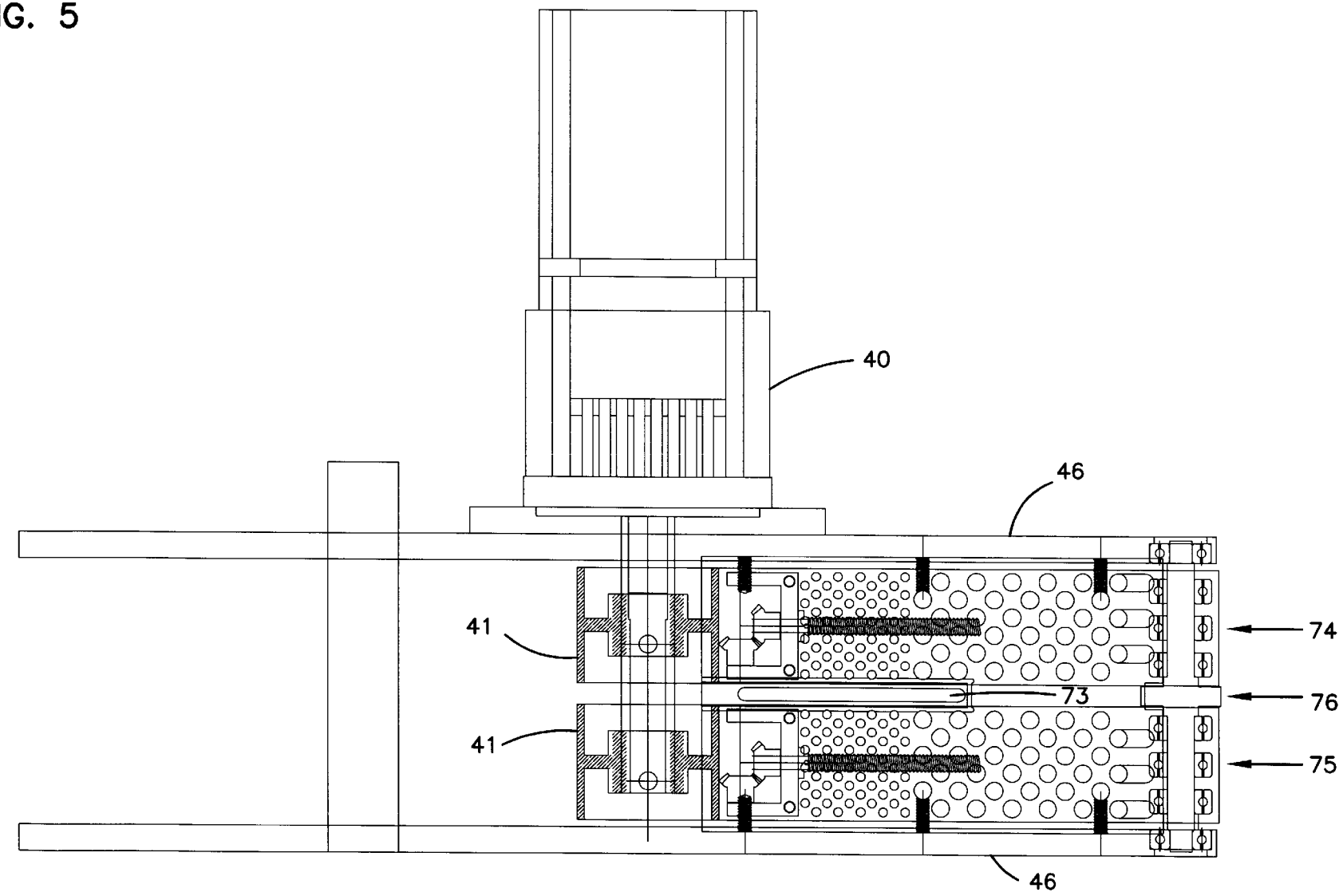
FIG. 5 is a top view of the labeling head.

FIG. 5 is a top view of labeling head 20. The vacuum belt 49 preferably comprises two separate sections or belts which are positioned over locations 74 and 75 such that they define a space over slot 73 in the vacuum plate 51. The use of a slot 73 in the vacuum plate 51 (see FIG. 6), and the gap 76 between the timing belts allows the through-beam sensors 43 and 56 to detect a position of a label on the vacuum belt.

Figure 6:
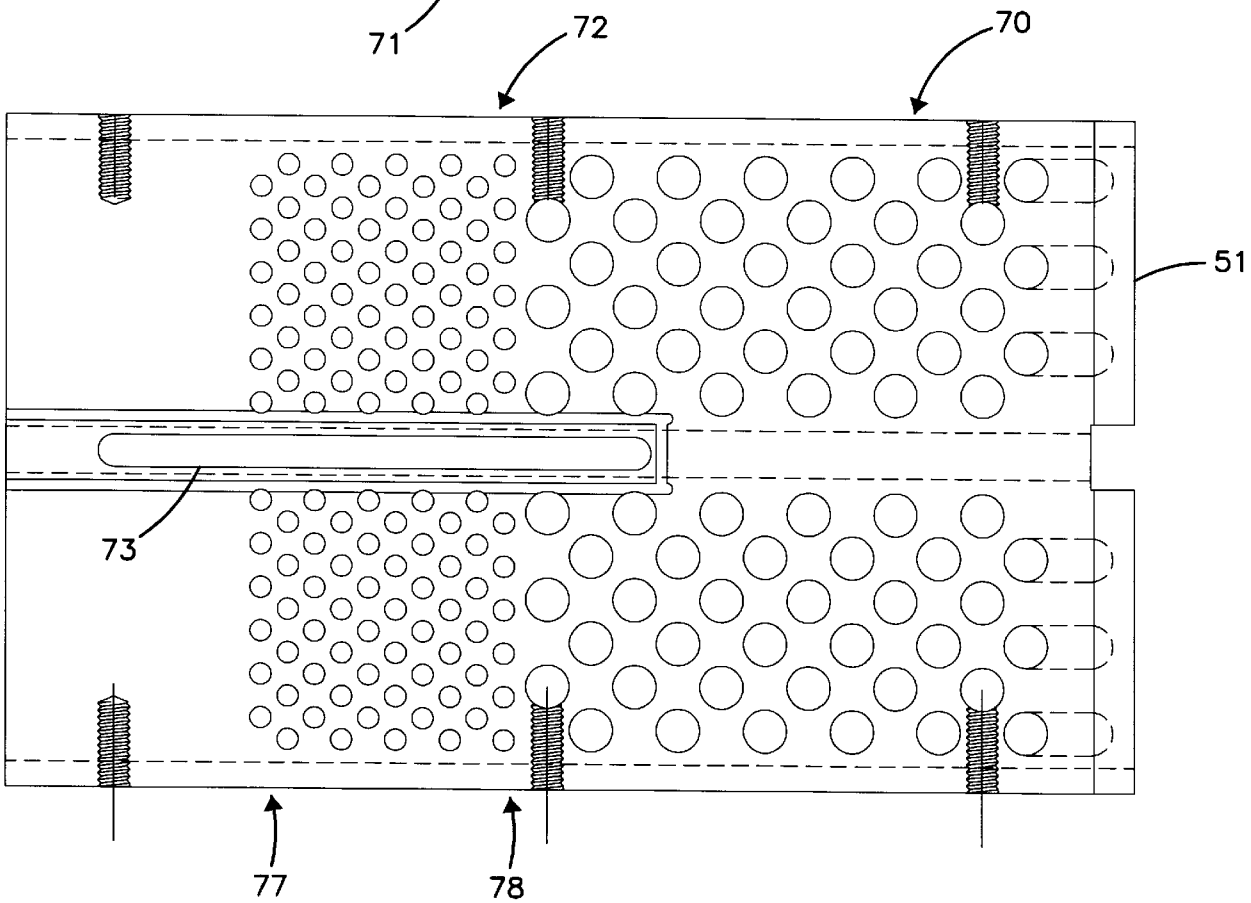
FIG. 6 is an enlarged view of the vacuum plate within the labeling head.

FIG. 6 is a more detailed diagram of the vacuum plate 51. As shown in FIG. 6, the vacuum plate 51 also defines a plurality of large holes 70 through which is applied the vacuum force. In addition, the vacuum plate 51 includes a plurality of smaller holes 72. These smaller holes 72 are used for obtaining a more discrete edge to the vacuum chamber 52 at a position of the baffle 54. The baffle 54 is typically adjustable anywhere between positions 77 and 78. Since smaller holes result in more holes being drilled within the vacuum plate, which increases the cost of manufacturing, the smaller holes 72 are only used within the baffle portion.

Figure 7:
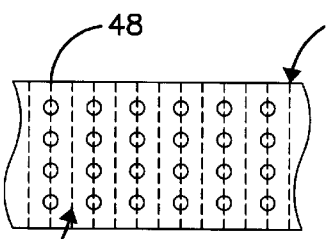
FIG. 7 is a view of a portion of the vacuum belt within the labeling head.

FIG. 7 is a more detailed diagram of the vacuum belt 49. As shown in FIG. 7, the vacuum belt 49 includes a plurality of holes 71 for transferring a vacuum force.

Figure 8:
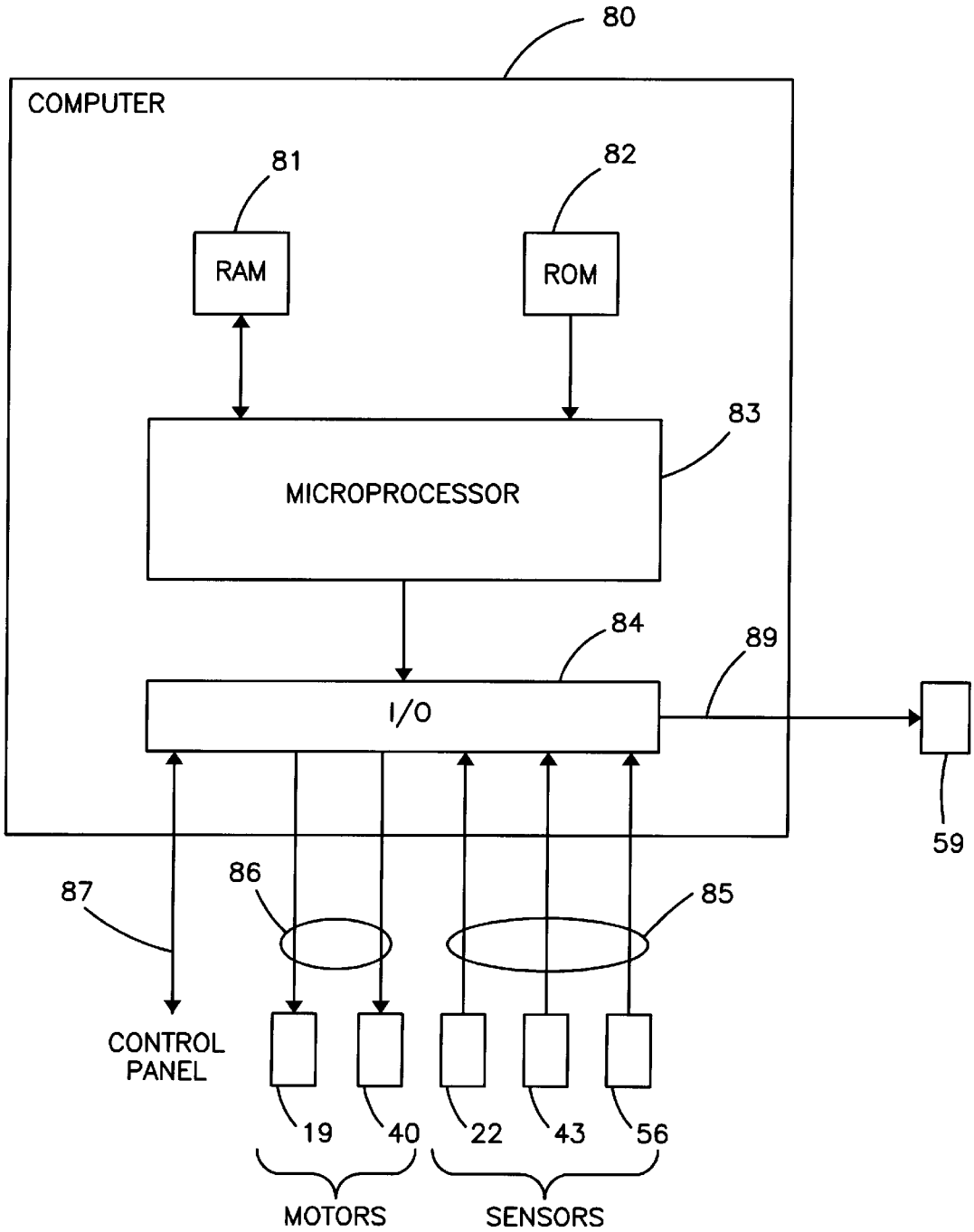
FIG. 8 is a block diagram of a control system for controlling the labelling head.

FIG. 8 is a block diagram of an example control system for controlling operation of the labeling head 20. The hardware of the control system typically includes a computer 80, which includes a RAM 81 for storing data, a ROM 82 for storing an embedded software program, and a microprocessor 83 for executing embedded software programs for controlling operation of the labeling head 20 and control panel 35. The microprocessor 83 is interfaced to the RAM 81 and the ROM 82. In addition, the microprocessor 83 is interfaced to an I/O device 84 for receiving information from the labeling head 20 and for outputting control signals. On input lines 85, the microprocessor 83 receives signals from the through-beam sensors 43 and 56, and the mark sensor 22. On output lines 86, the microprocessor 83 outputs control signals to the vacuum belt motor 40 and the web motor 19. On line 87, the microprocessor 83 receives information from and transmits information to the control panel 35 in the cabinet 10. On output line 89, the microprocessor 83 outputs control signals to the airstream device 59.

Figure 9:
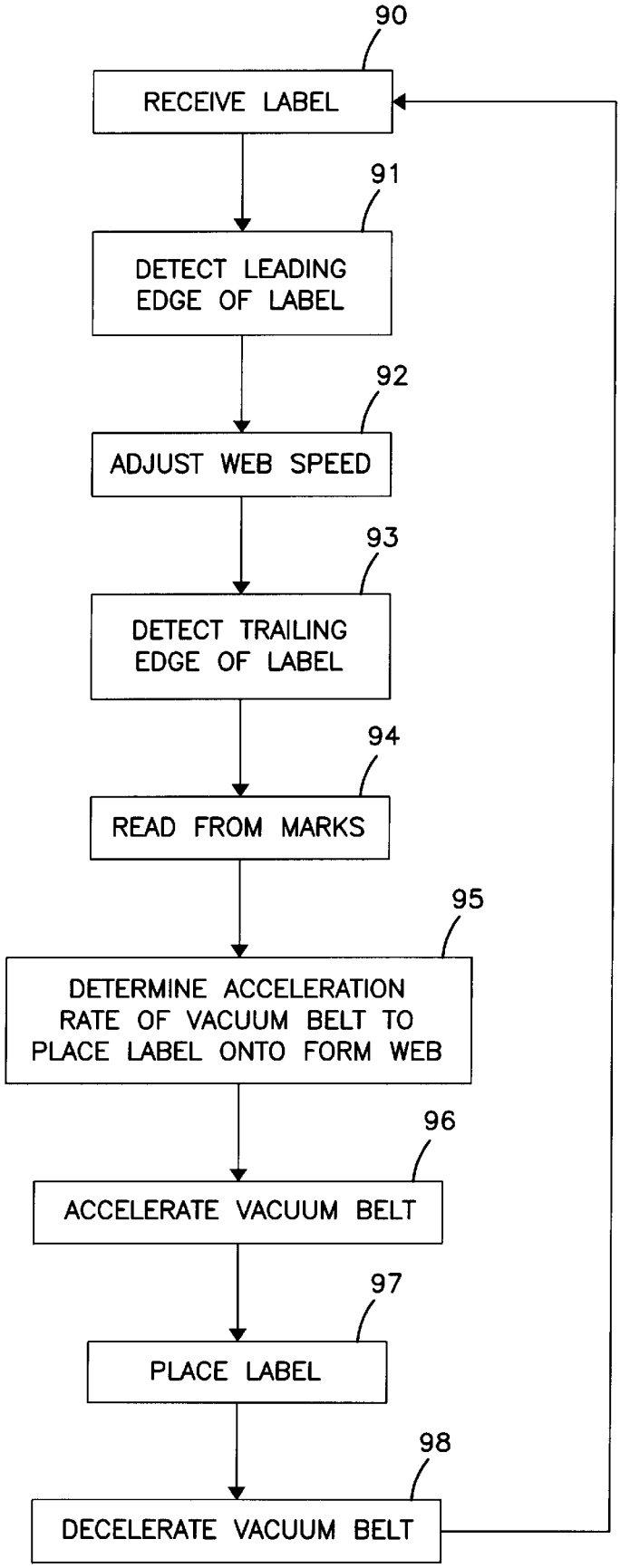
FIG. 9 is a flow chart of a preferred process for controlling operation of the labeling head for applying labels to moving articles.

FIG. 9 is a flow chart of a preferred process for controlling operation of the labeling head 20 using the control system shown in FIG. 8. The labeling head 20 first receives a label (step 90) from the edge surface 58 of the web conveying bracket 61. The system detects the leading edge of the label using through-beam sensor 43 (step 91). Based upon a position of the leading edge of the label, the system adjusts the web speed (label web) by controlling the label web motor 19 (step 92). The system then detects the trailing edge (or the leading edge) of the label on the vacuum belt 49 using through-beam sensor 56 (step 93). The system also reads the form marks using mark sensor 22 and corresponding detector 23 (step 94). The through-beam sensor 56 can also be used to determine a length of the label.

Based upon a position of the trailing edge (or the leading edge) of the label on the vacuum belt (step 93) and a position of the form web (step 94), the system calculates an acceleration rate of the vacuum belt in order to place the label onto the form web at the appropriate location. This calculation is accomplished in step 95. Based on the results of the calculation in step 95, the system outputs a control signal to the vacuum belt motor 40 in order to accelerate the vacuum belt according to the calculated rate (step 96). Upon acceleration, the vacuum belt increases a speed of the label in order to match a speed of the form web and place the label onto the form web. When the label on the vacuum belt reaches the roller 50, the label is applied to the form web, since the roller is located past the vacuum chamber and thus no vacuum force is present beneath the roller 50. This is accomplished in step 97. The system then decelerates the vacuum belt in order to approximately match a speed of the labels received from the web conveying bracket 61 and to receive another label (step 98).

An optional learn mode allows one to program the system for particular labels and forms. In the learn mode, the apparatus dispenses one label, reads it with the through-beam sensors to obtain its length, and reads the form with the mark sensor.

An exemplary program for controlling the label web motor 19 and the vacuum belt motor 40, both being servo motors, is provided below.

```
LABEL WEB SERVO CONTROL:
GEAR=-0.125
GEAREN=ON
INT 1 ON
INT 2 ON
WAIT F12 ON
V2=I1P1-I2P1
V3=V2-0.085
MOUD=-V3, V=500
V4=I1P2+3.75
WAIT POS2>V4
FI1 OFF
FI2 OFF
JUMP MAIN
VACUUM BELT SERVO CONTROL:
GEAREN=ON
FI1=OFF
FI2=OFF
INT 1 ON
INT 2 ON
WAIT FI1=ON
GEAR=0.55
WAIT FI2=ON
V2=I2P2-I1P2-1.7843
MOUD=V2
WAIT POS1>I1P1+4.8
GEAR=0.070
FI1=OFF
FI2=OFF
JUMP MAIN
```

Preferably, the label web motor 19 is run at a set speed proportionally less than the preset form speed. By using sensors 22, 43 and 56, appropriate pre-programmed variables, and appropriate programming using the encoder pulses of the servo motors, the labeling head 20 and the label web motor 19 allows for the label to match the velocity of the form web and also for correction of position. The above programs are provided merely for illustration purposes to show the various steps for matching the form web speed for one label placement situation. In particular, the above programs include pre-programming of the servo delay for placement of the label relative to the mark, the label length, and the form length.

Figure 10:
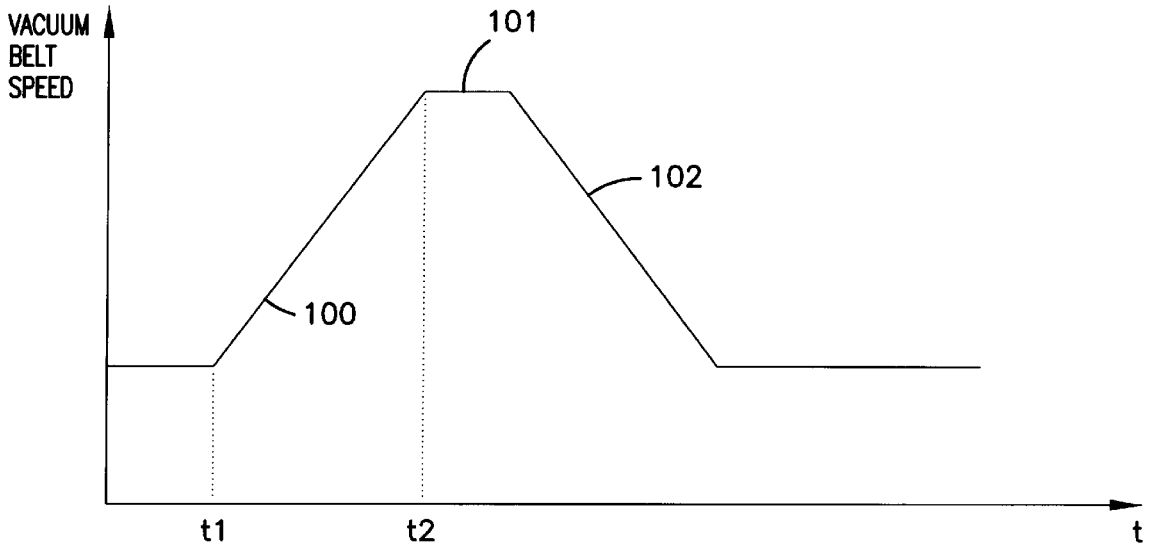
FIG. 10 is a graph illustrating the speed of a vacuum belt in the labeling head when used to apply labels according to the principles of the present invention.

FIG. 10 is a graph illustrating a speed of the vacuum belt 49 as it applies labels onto the moving form web. Generally the label web motor 19 is operated at a constant speed (with correction), and the vacuum belt 49 is alternately speeded up and slowed down to transfer the label from a slower moving label web to a faster moving form web. At 100, the vacuum belt accelerates in order to place the label onto the moving form web. As the label is placed onto the form web, the speed of the vacuum belt is approximately constant at 101. The vacuum belt then decelerates at 102 in order to receive another label. The time between times t1 and t2 thus allows for a significant amount of time for error correction and accurate placement of the label onto the moving form web, especially in comparison to prior art devices. The use of the variable speed vacuum belt also allows for receiving labels at a lower speed to avoid problems with label web breakage and placement of labels at a higher speed to match printing speeds of the form web. This provides the advantage of applying labels during a high speed printing operation, as opposed to taking the form web "off line" in order to lower its speed. In the case of applying labels to promotional literature, the labels can now be placed on the forms moving at 500 feet/minute. This is over twice the speed which was used in the past due to the label web tearing problem as the label web was alternately accelerated and decelerated.

While the present invention has been described in connection with a preferred embodiment thereof, it will be understood that many modifications will be readily apparent to those skilled in the art, and this application is intended to cover any adaptations or variations thereof. It is manifestly intended that this invention be limited only by the claims and equivalents thereof.

What is claimed is:

1. An apparatus for transferring adhesive labels from a backing web onto moving articles, comprising:

an article conveying system configured and arranged to move articles in a first direction;

a base;

a belt mounted to the base for rotational movement, the belt having an inner surface and an outer surface and defining a plurality of holes extending from the inner surface to the outer surface;

a motor coupled to cause rotational movement of the belt;

a vacuum chamber located proximate the base for applying a vacuum force through the holes in the belt, the vacuum chamber including a vacuum plate positioned adjacent to the inner surface of the belt, the vacuum plate defining a plurality of holes, the vacuum chamber further including a baffle slidably mounted to the base for changing an effective size of the vacuum chamber; and a control system, coupled to the motor, for controlling the rotational movement of the belt so that the belt receives on the outer surface, using the vacuum force, a non-adhesive side of a label without the web backing and accelerates the label for placement upon a moving article, the outer surface of the belt defining a belt-to-article transfer portion which moves generally in the same first direction as the moving articles for transfer of the label to the moving article on the article conveying system.

2. The apparatus of claim 1 wherein the baffle moves within a first area of the vacuum plate which includes a first plurality of holes and wherein the vacuum plate includes a second plurality of holes in a second portion of the vacuum plate, the second plurality of holes having a larger size than the first plurality of holes.

3. The apparatus of claim 1 wherein the belt includes a plurality of grooves on the inner surface of the belt.

4. The apparatus of claim 1 wherein the control system comprises:

an input device for receiving a first signal representing a location of the article relative to the belt, a second signal representing a location of the label on the belt, and a third signal representing a speed of the article; and programmed logic, coupled to the input device, the programmed logic being configured to determine, using the first, second, and third signals, a rate of acceleration of the belt in order to substantially match the speed of the article upon placement of the label, and to output a signal to the motor in order to cause the motor to move the belt at the determined rate of acceleration.

5. The apparatus of claim 4, further comprising a first sensor located proximate the moving article for providing the first signal, and a second sensor located proximate the base for detecting an edge of the label on the belt in order to provide the second signal.

6. The apparatus of claim 1, further comprising a device for removing the backing web from the labels.

7. The apparatus of claim 6 wherein the control system causes the motor to decelerate the belt in order to receive another label without the backing web.

8. The apparatus of claim 7 wherein the control system further comprises:

an input device for receiving a first signal representing a speed of the belt upon placement of the label and a second signal representing a speed at which the device removes the backing web from the labels; and programmed logic coupled to the input device, the programmed logic being configured to determine, using the first and second signals, a rate of deceleration of the belt in order to substantially match the speed at which the backing web is removed upon receiving another label from the backing web, and to output a signal to the motor in order to cause the motor to move the belt at the determined rate of deceleration.

9. The apparatus of claim 6 wherein the device comprises:

an edge surface located adjacent the base, the backing web having the labels to be placed around the edge surface; and a second motor for pulling the backing web around the edge surface so that the labels separate from the backing web at the edge surface.

10. The apparatus of claim 9, further comprising an air stream device for applying a stream of air to the adhesive side of the label separated from the backing web at the edge surface in order to force the label against the outer surface of the belt.

11. The apparatus of claim 1 wherein the control system causes acceleration of the belt to place the label onto a moving form web, the moving form web including a plurality of forms as the articles.

12. The apparatus of claim 1 wherein the vacuum plate defines a slot outside of the vacuum chamber.

13. The apparatus of claim 12 wherein the belt comprises two belts which are spaced apart at the slot in the vacuum plate.

14. An apparatus for transferring adhesive labels from a backing web onto moving articles, comprising:

an article conveying system configured and arranged to move articles in a first direction;

a backing web conveying device including a dispensing lip for receiving a backing web with adhesive labels, wherein the backing web is conveyed past the dispensing lip to separate the labels from the backing web;

a base connected to the backing web conveying device;

a drive roller rotatably mounted to the base;

a belt mounted to the base to be rotated by the drive roller, the belt having an inner surface and an outer surface and defining a plurality of holes extending from the inner surface to the outer surface, the outer surface of the belt defining a belt-to-article transfer portion which moves generally in the same first direction as the moving articles;

a motor mounted to drive the drive roller; and a vacuum chamber located adjacent to the inner surface of the belt for applying a vacuum force through the holes in the belt to the outer surface, the belt being positioned adjacent to the dispensing lip of the backing web conveying device to receive labels separated from the backing web, the vacuum chamber including a vacuum plate positioned adjacent to the inner surface of the belt, the vacuum plate defining a plurality of holes, the vacuum chamber further including a baffle slidably mounted to the base for changing an effective size of the vacuum chamber.

15. The apparatus of claim 14 wherein the baffle moves within a first area of the vacuum plate which includes a first plurality of holes and wherein the vacuum plate includes a second plurality of holes in a second portion of the vacuum plate, the second plurality of holes having a larger size than the first plurality of holes.

16. An apparatus for transferring adhesive labels from a backing web onto moving articles, comprising:

a base;

a belt mounted to the base for rotational movement, the belt having an inner surface and an outer surface and defining a plurality of holes extending from the inner surface to the outer surface;

a motor coupled to cause rotational movement of the belt;

a vacuum chamber located proximate the base for applying a vacuum force through the holes in the belt, the vacuum chamber including a vacuum plate positioned adjacent to the inner surface of the belt, the vacuum plate defining a plurality of holes, the vacuum chamber further including a baffle slidably mounted to the base for changing an effective size of the vacuum chamber; and a control system, coupled to the motor, for controlling the rotational movement of the belt so that the belt receives on the outer surface, using the vacuum force, a non-adhesive side of a label without the web backing and accelerates the label for placement upon a moving article.

17. The apparatus of claim 16 wherein the baffle moves within a first area of the vacuum plate which includes a first plurality of holes and wherein the vacuum plate includes a second plurality of holes in a second portion of the vacuum plate, the second plurality of holes having a larger size than the first plurality of holes.

18. An apparatus for transferring adhesive labels from a backing web onto moving articles, comprising:

a base;

a belt mounted to the base for rotational movement, the belt having an inner surface and an outer surface and defining a plurality of holes extending from the inner surface to the outer surface;

a motor coupled to cause rotational movement of the belt;

a vacuum chamber located proximate the base for applying a vacuum force through the holes in the belt, the vacuum chamber including a vacuum plate positioned adjacent to the inner surface of the belt, the vacuum plate defining a plurality of holes, the vacuum chamber further including a baffle slidably mounted to the base for changing an effective size of the vacuum chamber; and a control system, coupled to the motor, for controlling the rotational movement of the belt so that the belt receives on the outer surface, using the vacuum force, a non-adhesive side of a label without the web backing and accelerates the label for placement upon a moving article, the control system including a sensor for sensing a position of the label received by the belt.

19. The apparatus of claim 18, wherein the control system further includes a second sensor for sensing a position of the moving articles.

20. The apparatus of claim 18 wherein the baffle moves within a first area of the vacuum plate which includes a first plurality of holes and wherein the vacuum plate includes a second plurality of holes in a second portion of the vacuum plate, the second plurality of holes having a larger size than the first plurality of holes.

* * * * *